US006371332B1

(12) United States Patent
Fox

(10) Patent No.: US 6,371,332 B1
(45) Date of Patent: Apr. 16, 2002

(54) APPARATUS FOR PRODUCING FOAM FROM LIQUID MIXTURE

(76) Inventor: Albert H. Fox, 3682 Gershwin Ave. North, Oakdale, MN (US) 55128

( * ) Notice: Subject to any disclaimer, the term of this patent is extended or adjusted under 35 U.S.C. 154(b) by 0 days.

(21) Appl. No.: 09/615,140

(22) Filed: Jul. 13, 2000

Related U.S. Application Data

(60) Provisional application No. 60/143,659, filed on Jul. 13, 1999, and provisional application No. 60/148,299, filed on Aug. 11, 1999.

(51) Int. Cl.[7] ..... B67D 5/58

(52) U.S. Cl. ..... 222/190; 222/195; 222/212

(58) Field of Search ..... 222/190, 212, 222/195, 209, 211, 401; 239/126, 310, 311, 327, 328, 339, 343, 372, 575, 590

(56) References Cited

U.S. PATENT DOCUMENTS

| | | | | | |
|---|---|---|---|---|---|
| 2,378,426 | A | | 6/1945 | Myers | 299/96 |
| 2,653,848 | A | | 9/1953 | Lee | 299/83 |
| 2,680,010 | A | | 6/1954 | DuBay | 261/124 |
| 2,853,212 | A | | 9/1958 | Anderson | 222/402 |
| 3,422,993 | A | | 1/1969 | Boehm et al. | 222/190 |
| 3,428,222 | A | | 2/1969 | Wright | 222/187 |
| 3,447,754 | A | | 6/1969 | Nohl | 239/343 |
| 3,471,064 | A | | 10/1969 | Micallef | 222/211 |
| 3,709,437 | A | | 1/1973 | Wright | 239/343 |
| 3,801,015 | A | | 4/1974 | Hayes | 239/175 |
| 3,937,364 | A | | 2/1976 | Wright | 222/190 |
| 3,970,219 | A | | 7/1976 | Spitzer et al. | 222/1 |
| 3,973,701 | A | * | 8/1976 | Gardner | 222/190 |
| 4,027,789 | A | * | 6/1977 | Dickey | 222/190 |
| 4,030,665 | A | | 6/1977 | Koyama | 239/373 |
| 4,140,737 | A | | 2/1979 | Hauser | 261/93 |
| 4,155,509 | A | | 5/1979 | Koyama | 239/308 |
| 4,156,505 | A | | 5/1979 | Bennett | 239/327 |
| 4,184,615 | A | * | 1/1980 | Wright | 222/190 |
| 4,213,936 | A | | 7/1980 | Lodrick | 422/133 |
| 4,219,159 | A | | 8/1980 | Wesner | 239/343 |
| 4,350,298 | A | | 9/1982 | Tada | 239/333 |
| 4,383,935 | A | | 5/1983 | Hull | 252/359 E |
| 4,420,098 | A | | 12/1983 | Bennett | 222/190 |
| 4,463,905 | A | | 8/1984 | Stoesser et al. | 239/329 |
| 4,531,659 | A | | 7/1985 | Wright | 222/190 |
| 4,598,862 | A | | 7/1986 | Rice | 239/8 |
| 4,603,812 | A | | 8/1986 | Stoesser et al. | 239/329 |
| 4,640,440 | A | * | 2/1987 | Ford, Jr. et al. | 222/190 |
| 4,646,973 | A | | 3/1987 | Focaracci | 239/428 |
| 4,730,751 | A | * | 3/1988 | Mackles et al. | 222/189 |
| 4,880,161 | A | | 11/1989 | Wright | 239/330 |
| RE33,564 | E | * | 4/1991 | Ford, Jr. | 222/209 |
| 5,222,633 | A | | 6/1993 | Blake | 222/179 |
| 5,269,444 | A | | 12/1993 | Wright | 222/190 |
| 5,431,345 | A | | 7/1995 | Lund et al. | 239/329 |
| 5,602,091 | A | | 2/1997 | Monson et al. | 510/406 |
| 5,725,129 | A | | 3/1998 | Chapin | 222/190 |
| 5,725,155 | A | | 3/1998 | Grunenberg et al. | 239/343 |
| 5,837,168 | A | | 11/1998 | Rowe | 261/78.2 |
| 5,984,146 | A | | 11/1999 | Kaufman | 222/190 |
| 6,086,278 | A | | 7/2000 | Keller | 401/183 |

* cited by examiner

*Primary Examiner*—Henry C. Yuen
*Assistant Examiner*—Melvin A Cartagena
(74) *Attorney, Agent, or Firm*—Michael S. Sherrill

(57) ABSTRACT

An apparatus for producing foam from a liquid mixture.

18 Claims, 10 Drawing Sheets

APPARATUS FOR PRODUCING FOAM FROM LIQUID MIXTURE

This application claims the benefit of U.S. Provisional Application No. 60/143,659, filed Jul. 13, 1999 and U.S. Provisional Application No. 60/148,299, filed Aug. 11, 1999.

FIELD OF THE INVENTION

The invention relates to an apparatus for producing foam from a liquid mixture.

BACKGROUND

Foam made from a soap and water mixture is a necessity in the lives of many people. For example, persons choosing to shave using a manual razor system must first lather the area to be shaved with foamed shaving cream. Shaving cream is foamed either by manually mixing water with a solid soap, by mixing water with a paste-type shaving cream, or by spraying liquid soap out of a shaving cream can. Manually mixing solid or paste-type soap with water is a time consuming process. Using shaving cream from a can is expensive and gives little indication as to when the supply is about to run out.

What is clearly needed then, is an apparatus and method for producing foam from a liquid mixture that is relatively quick to prepare and inexpensive, and allows the user a greater degree of warning that the supply is about to run out.

SUMMARY OF THE INVENTION

One embodiment of the invention includes a device having an elastic pliant bottle defining a single bottle chamber with an upper portion and a lower portion and an air intake orifice through the bottle in one way fluid communication with the lower portion of the bottle chamber. An aerator is contained within the bottle chamber in sealing fluid communication with the air intake orifice and a foam exit port from the bottle chamber is in one way fluid communication with the upper portion. When air is drawn into the bottle chamber through the air intake orifice foam is formed when the bottle resumes an original shape after being deformed. Finally, foam is expelled from bottle chamber through the foam exit port when the bottle is again deformed.

Another aspect of the invention includes a method of forming and dispensing foam, including obtaining the device described in the paragraph immediately above. A foamable liquid is placed within the lower portion of the bottle chamber and air is forced into the bottle chamber through the air intake orifice so as to form foam within the upper portion of the bottle chamber. Air is continued to be forced into the bottle chamber until sufficient foam is formed to cause the foam to exit the bottle chamber through the foam exit port.

Another embodiment of the invention includes a device consisting of an elastic pliant bottle defining a bottle chamber having an upper portion, a lower portion and an original shape. A foamable liquid is contained within the lower portion of the bottle chamber and a port extends through the bottle in fluid communication with the upper portion of the bottle chamber. When the foamable liquid within the bottle chamber is agitated the foamable liquid mixes with air and foam forms. Squeezing the bottle causes the foam to exit the bottle chamber through the port. When squeezing is discontinued the bottle chamber returns to the original shape with the suction of air into the bottle chamber.

Another aspect of the invention includes a method of forming and dispensing foam, including obtaining the device described in the paragraph immediately above. The foamable liquid within the bottle is agitated so as to form foam within the upper portion of the bottle chamber. Finally the bottle is squeezed so as to deform the bottle chamber and thereby cause the foam to exit the bottle chamber through the port.

A further embodiment of the invention includes a device having an elastic pliant bottle defining a single bottle chamber having an upper portion, a lower portion and an original shape. A foamable liquid is contained within the lower portion of the bottle chamber and a port extends through the bottle in fluid communication with the upper portion of the bottle chamber. When the foamable liquid within the bottle chamber is agitated the foamable liquid mixes with air and foam forms. Squeezing the bottle causes the foam to exit the bottle chamber through the port. When squeezing is discontinued the bottle chamber returns to the original shape with the suction of air into the bottle chamber.

Another aspect of the invention includes a method of forming and dispensing foam, including obtaining the device described in the paragraph immediately above. The foamable liquid within the bottle is agitated so as to form foam within the upper portion of the bottle chamber. Squeezing the bottle deforms the bottle chamber thereby causing the foam to exit the bottle chamber through the port.

Yet another embodiment of the invention includes a device having an elastic pliant bottle defining a bottle chamber having an upper portion, a lower portion and an original shape. A foamable liquid is contained within the lower portion of the bottle chamber and a port extends through the bottle in unobstructed fluid communication with the upper portion of the bottle chamber. When the foamable liquid within the bottle chamber is agitated, the foamable liquid mixes with air and foam forms. Squeezing the bottle causes the foam to exit the bottle chamber through the port. When squeezing is discontinued the bottle chamber returns to the original shape with the suction of air into the bottle chamber.

Another aspect of the invention includes a method of forming and dispensing foam, including obtaining the device described in the paragraph immediately above. The foamable liquid within the bottle is agitated so as to form foam within the upper portion of the bottle chamber. Squeezing the bottle deforms the bottle chamber thereby causing the foam to exit the bottle chamber through the port.

DETAILED DESCRIPTION OF THE INVENTION INCLUDING A BEST MODE

Nomenclature

10 Device (First Embodiment)
11 External Manually Operated Air Pump
12 Splice Between Air Pump and Tubing
13 Tubing
14 Splice Between Tubing and One-Way Valve
15 One-Way Flow Valve
16 Container
17 Tubing
18 Aerator
19 Bottom of Container
20 Liquid
21 Air Space
22 Top of Container
23 Container Cap
24 Exit Tube for Foam
25 Exit Nozzle for Foam
31 Air Entry Port
32 First One-Way Valve
33 Sleeve Which Joins One-Way Valve to Tubing
34 Foam Exit Tubing
35 Sleeve
36 Second One-Way Valve
37 Foam Exit Tubing
38 Foam Exit Nozzle
39 Tubing
40 Container
41 Aerator
42 Bottom of Container
43 Liquid
44 Air Space or Foam-Collecting Zone
45 Top of Container
46 Tubing
47 Container Cap
51 Tube Opening for Both Air Entry and Foam Exit
52 Tube for Both Air Entry and Foam Exit
54 Container Cap
55 Junction of Air Entry Tubing and Foam Exit Tubing
56 Air Entry Tubing
57 Container
58 First One-Way Valve
59 Tubing
60 Aerator
61 Container Bottom
62 Foamable Liquid
63 Second One-Way Valve
64 Air Space
65 Top of Container
100 Device (Second Embodiment)
111 Plunger Handle
112 Plunger Shaft
113 Pump Body
114 Plunger
115 Air Exit Holes
116 One-Way Valve
117 Wall of Pump Body
118 Top of Pump Body
121 Wall of Pump Body
122 Air Exit Holes
123 One-Way Valve
124 Aerator
125 Sleeve
131 Wall of Pump Body
132 Retaining Sleeve
133 Porous Fabric
134 Air Exit Holes
135 One-Way Valve
136 Retaining Sleeve
141 Wall of Pump Body
142 Air Exit Holes
143 Porous Fabric
144 One-Way Valve
151 Wall of Pump Body
152 Plumbing Fitting
153 Tubing
154 One-Way Valve
155 Tubing
156 Aerator
161 Plunger Handle
162 Plunger Shaft
163 Wall of Pump Body
164 Plunger
165 One-Way Valve
166 Bottom of Pump Body
167 Wall of Pump Body
168 Air Exit Hole(s)
169 Top of Pump Body
200 Device (Third Embodiment)
211 Tube Opening for Both Air Entry and Foam Exit
212 Tube for Both Air Entry and Foam Exit
213 Hole(s) in the Dip Tube Which Allow Air to Enter
214 Dip Tube
215 Container
216 Bottom of Container
217 Liquid
218 Air Space
219 Top of Container
220 Container Cap
231 Tube Opening for Both Air Entry and Foam Exit
232 Tube for Both Air Entry and Foam Exit
233 Tube Opening for Both Air Entry and Foam Exit
234 Container
235 Bottom of Container
236 Liquid
237 Air Space
238 Top of Container
239 Container Cap
300 Device (Fourth Embodiment)
400 Device (Fifth Embodiment)

Construction

Figure 1:
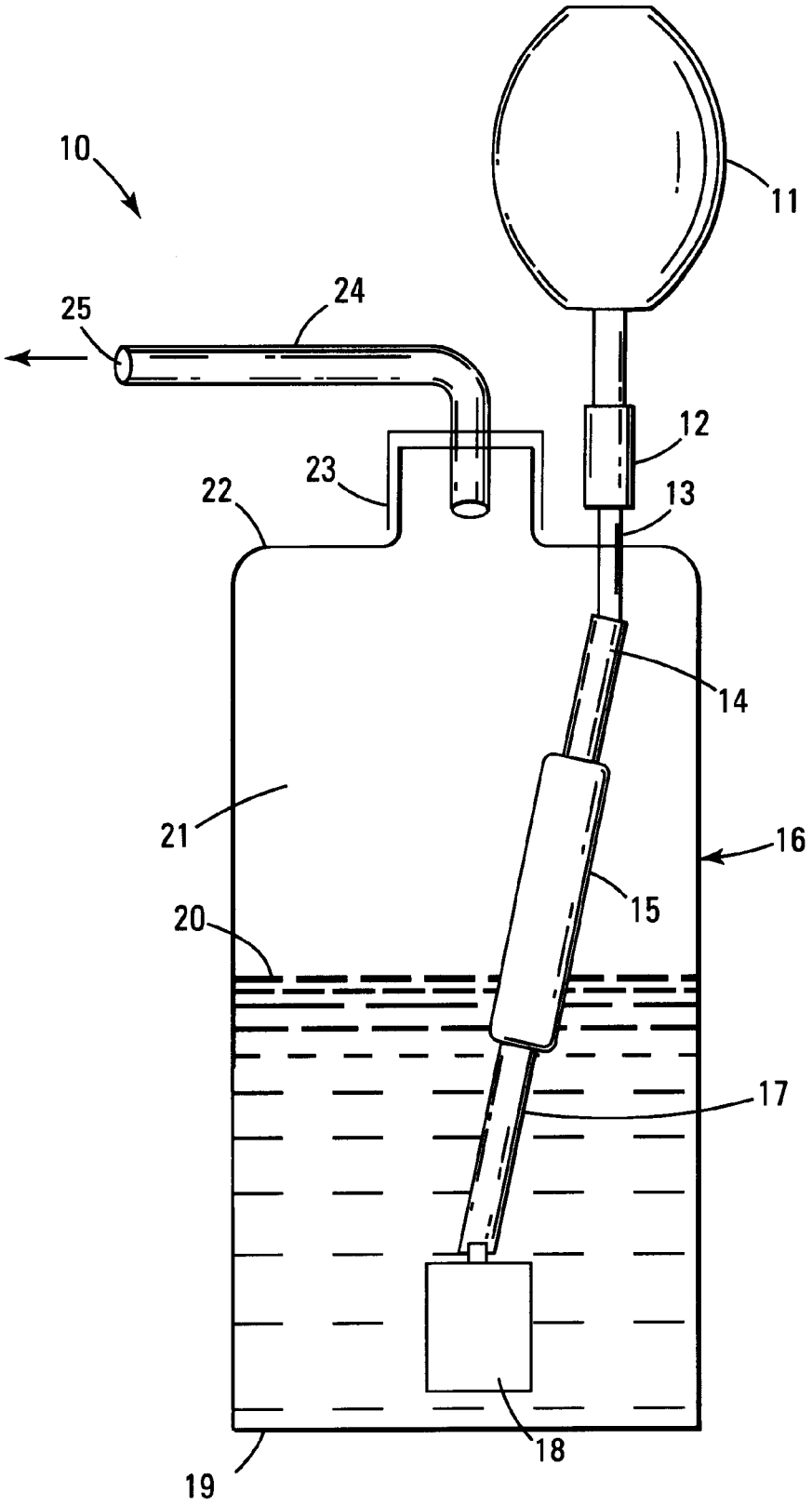
FIG. 1 is the side view of a first embodiment of the invention.

FIG. 1 shows a first embodiment of the device 10, which defines a container 16 defining an air space 21 and a bottom 19. An external manually operated air pump 11 delivers air to an aerator 18, which is located near the bottom of liquid 20 located within the container 16. The air pump 11 can be connected by a splice 12, which is connected by tubing 13 to a splice 14, all of which are connected to and in sealing fluid communication with one-way flow valve 15. The one-way flow valve 15 located between the air pump 11 and the aerator 18, prevents the pressurized liquid 20 from flowing back into the air pump 11 following the forcing of air through the aerator 18. The one-way flow valve 15 as illustrated is a commercially available lab-supply flow valve which uses "flappers" (flat, diaphragm type flow valves)(not shown). Tubing 17 is connected to the aerator 18, in fluid communication with the air pump 11, splice 12, tubing 13, splice 14, one-way flow valve 15, tubing 17 and aerator 18. Thus, when air is forced out of the air pump 11, it flows directly to the aerator 18. Air leaving the aerator 18 forms small bubbles in the liquid 20, which rise toward the top of the container 22 through the liquid 20 filling the air space 21 on top of the liquid 20. With pressure inside the container 16 being higher than ambient air pressure, the bubbles are compressed into foam as they leave the container 16 and flow through the exit tube 24. If more internal pressurization is desired, an exit nozzle 25 or tubing flow restrictor (not shown) may be used. A cap 23 is removably attached, preferably by threaded means (not shown) to enable replenishment of liquid 20, as well as to maintain a pressurized internal environment within the container 16.

The liquid 20 is preferably a mixture of water and baby shampoo. A 50/50 ratio of water and baby shampoo produces a thick foam, which is desirable for such uses as shaving cream. The 50/50 ratio liquid 20 also makes foam that is suitable for toy uses, garden spraying uses, fire extinguisher uses, etc. However, liquid 20 mixtures which contain lesser percentages of baby shampoo (ratios as low as about 10% baby shampoo and 90% water) still produce suitable foam for many of the previously mentioned uses.

Other "soaps" besides baby shampoo may be mixed with water make the foam-forming liquid 20. Dish washing liquid, baby wash, bubble bath, etc, are also suitable.

Small bubbles are preferred. If no aerator 18 is used on the end of the air-supply tubing 17, undesirable large bubbles are formed. Producing usable quantities of foam from such large bubbles takes much greater air flow. The use of an aerator 18 allows the device 10 to produce a greater amount of foam with a lesser amount of air required.

The aerator 18 may be one of many inexpensive variations: an aquarium bubbler-stone (not shown), a fine mesh screen, small holes in a tube, a porous fabric, etc.

The manually operated air pump 11 is a squeeze bulb type. A plunger pump (not shown) is also suitable. A bellows pump (not shown) or any other manually operated pump is also suitable.

A powered air pump (not shown) is suitable for those applications requiring a more constant flow of foam, or a higher volume of flow, or for operators not physically inclined to provide the required air flow manually. An inexpensive powered air pump (not shown) is achieved by using a battery-powered minnow-bucket aeration air pump (not shown); piston pumps (not shown) deliver higher pressure than diaphragm pumps (not shown). Air compressors (not shown) are a version of more expensive air pumps (not shown) that deliver higher flow rates at higher pressure.

The container 16 as shown in FIG. 1 is a semi-transparent plastic (LDPE) 500 ml bottle. The bottle is transparent enough that the user is able to see the formation of bubbles and foam, which is an advantage for some uses. The 500 ml size of the container 16 is a good size for some children's toys, and making foam for shaving cream use (other size containers 16 may be used where different capacity is desired). Other containers 16 may be more advantageous for other uses of foam. Materials suitable for the manually operated air pump 11 include various kinds of rubber or plastic materials that are able to resume their original shape following deformation resulting from use. Materials suitable for the splice 12, tubing 13, splice 14 and tubing 17 include plastic materials such as polyethylene due to durability and relatively low cost.

An alternative embodiment (not shown) has one air pump (not shown) connected to multiple containers (not shown), via a gang valve (not shown). Each container is similar to the container 16 of FIG. 1 except that the manually operated air pump 11 is replaced by tubing (not shown) which delivers air from the gang valve. The gang valve settings control which containers (not shown) receive the pumped air, and then produce and expel foam. Liquid (not shown) in each container (not shown) could include colorant, so that container selection controls which color foam is produced. This embodiment is suitable for children's bath toys, etc.

Figure 2:
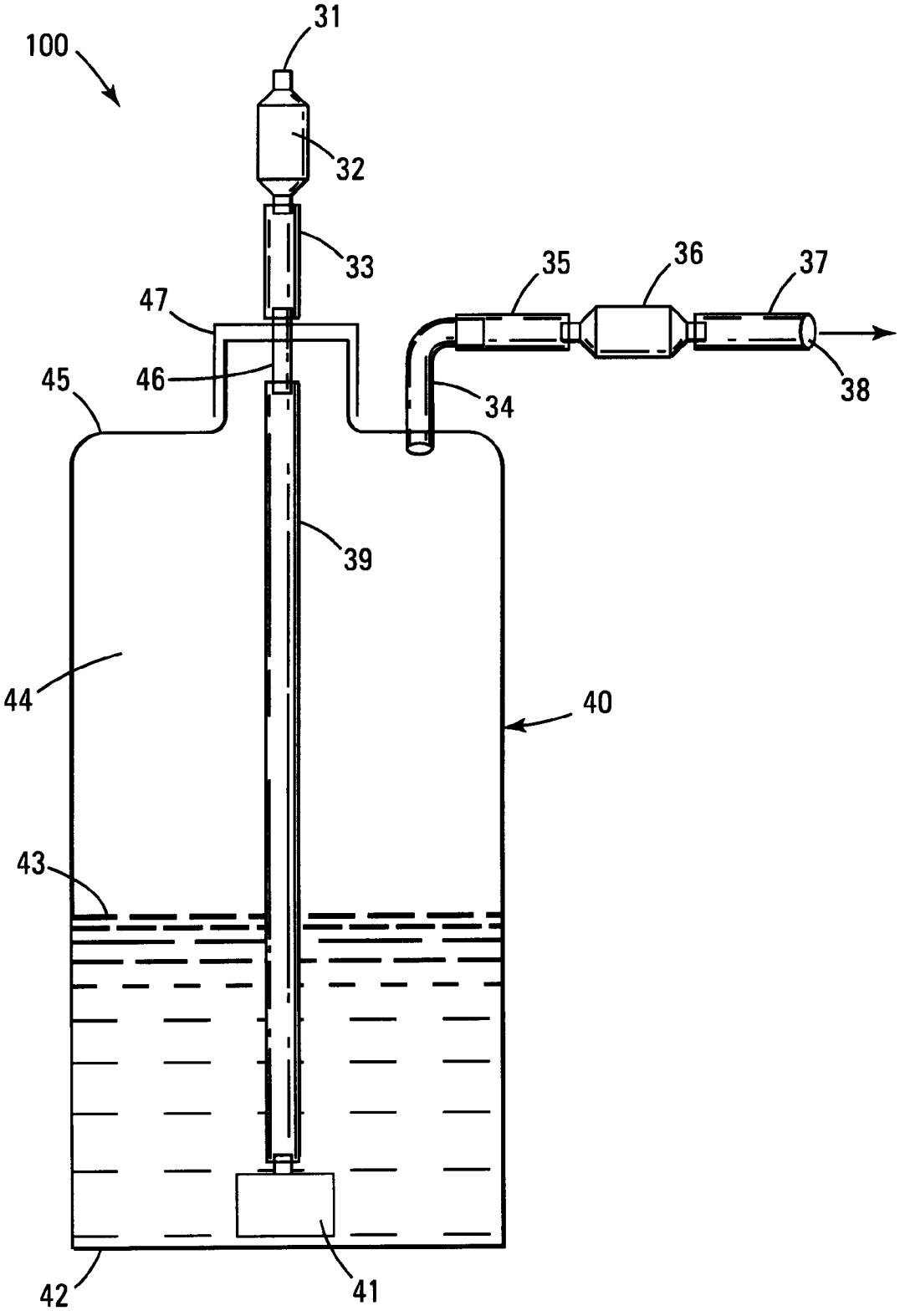
FIG. 2 is the side view of a second embodiment of the invention.

FIG. 2 shows a second embodiment of a foam-generating device 100 which uses its own container 40 as an air pump. The container 40 defines a bottom 42 and top 45, which is adapted to receive a cap 47 for replenishing liquid 43. Squeezing the container 40 expels air, and as the container 40 expands to its original shape, it draws air into itself through the air entry port 31. The air entry port 31 is in fluid communication with a first one-way valve 32 which is in fluid communication with a sleeve 33 in fluid communication with and joining tubing 46 to tubing 39 which is in sealing fluid communication with the aerator 41. Air is thus directed through the aerator 41 near the bottom 42 of the container 40. Small bubbles are formed, which rise toward the top of the container 45 through the liquid 43 into the air space 44. As the container 40 is squeezed, the bubbles are compressed and expelled through fluidly communicating foam exit tubing 34, sleeve 35, second one way valve 36 foam exit tubing 37 and foam exit nozzle 38, as foam. The second one-way valve 36 ensures that the flow from the container 40 is in the appropriate direction.

If the foam exit nozzle 38 or tubing 37 is sufficiently restricted, a second one-way valve 36 may not be required. When the container 40 expands to fill with air, most of the air will enter through the aerator 41. Covering the entry port 31 while the container 40 is squeezed makes the foam exit through the foam exit nozzle 38.

Figure 3:
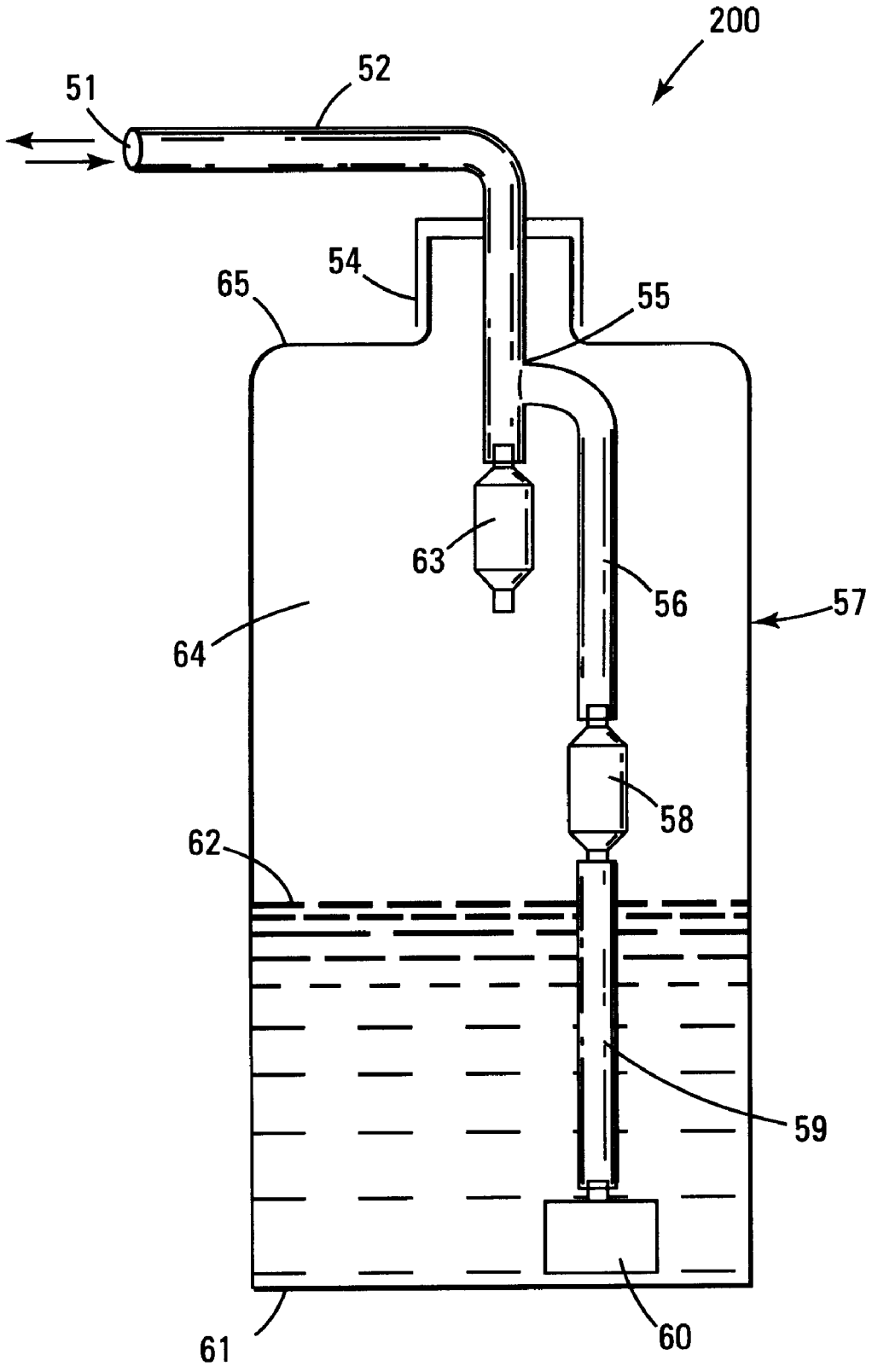
FIG. 3 is the side view of a third embodiment of the invention.

FIG. 3 shows a third embodiment of the foam generation device 200. In this embodiment, container 57 uses itself as the air pump. The container defines a bottom 61 and top 65, which is further adapted to receive a removable cap 54 for replenishing liquid 62. The air-in function and the foam exit function share a common tube 52. The common tube 52 defines an opening 51 for the dual purposes of allowing air to enter the container 57 as well as allowing foam to exit. A first one-way valve 58 is in sealing fluid communication between the air entry tubing 56 and tubing 59, which is in sealing fluid communication with the aerator 60. A junction 55 is defined where the air entry tubing 56 joins the common tube 52. Additionally, a second one-way valve 63 is attached to the common tube 52 to force the produced foam to only be able to be expelled from the container 57. The first 58 and second 63 one-way valves in this embodiment are located inside the container 57. When liquid 62 is poured into the container 57, care should be taken to ensure that a sufficient air space 64 is created to allow for the formation of foam following the introduction of air through the liquid 62. The function of the device 200 is the same as the embodiment shown in FIG. 2.

Modified garden sprayers make good foam-producing sprayers in larger sizes (½ gallon, 1 gallon, 2 gallon, 3 gallon etc.). Uses for large foam-producing containers (not shown) include modified garden sprayers which spray their contents out in foam-form (the gardening contents would be mixed with the foaming liquid), fire extinguishers, large volume children's toys, etc.

Figure 4:
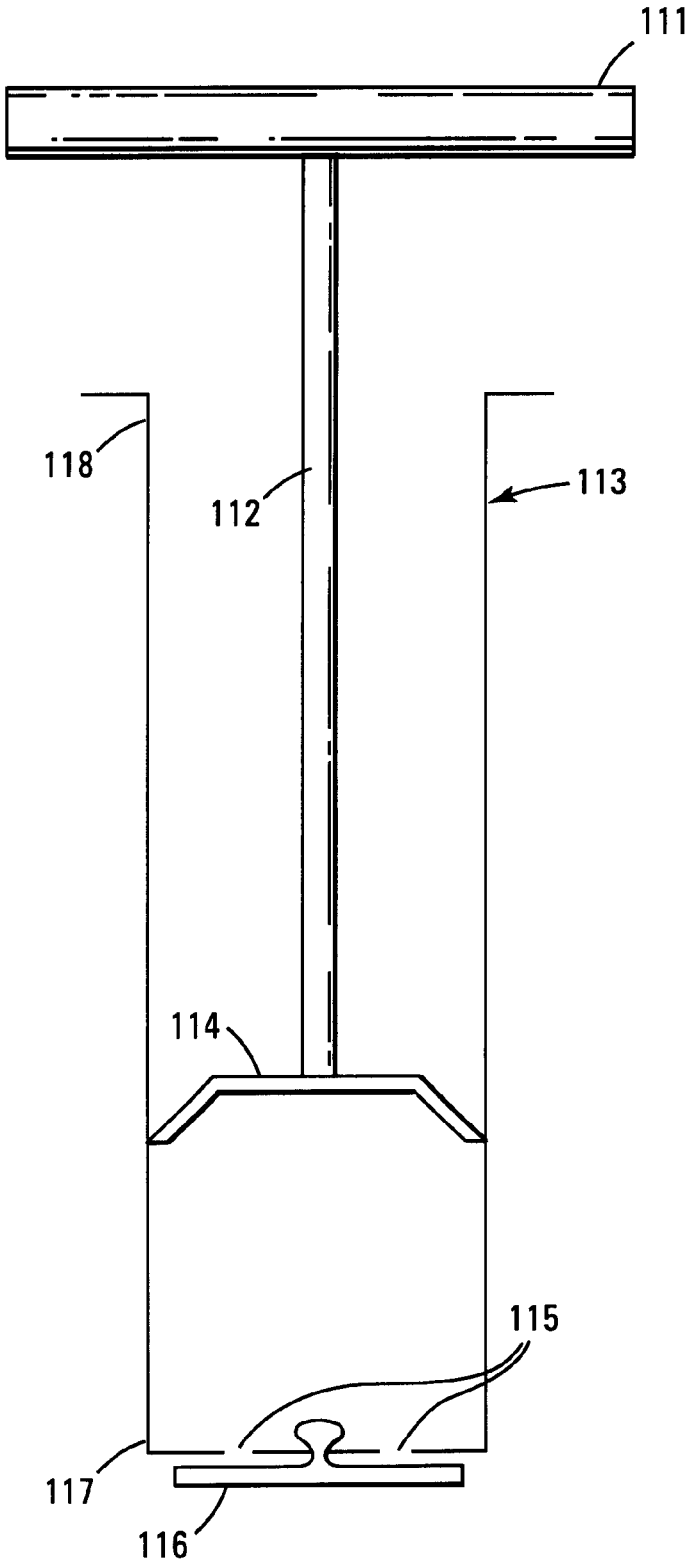
Fig. 4 Prior Art
FIG. 4 is the side view of a prior art garden sprayer pump.

FIG. 4 shows a plunger 114 from a garden sprayer. The plunger 114 is sealingly slidably fitted within the wall 117 of the pump body 113 which also defines a top side 118. A plunger shaft 112 is attached to the plunger 114, and a handle 111 is attached to the end of the plunger shaft 112 opposite the plunger 114. Air exit holes 115 are located in the pump body 113 at the end (unnumbered) opposite the top side 118. A one way valve 116 is located adjacent to the air exit holes 115 such that the downward motion of the plunger 114 causes the one way valve 116 to allow air to exit the pump body 113 through the air exit holes 115.

Figure 5:
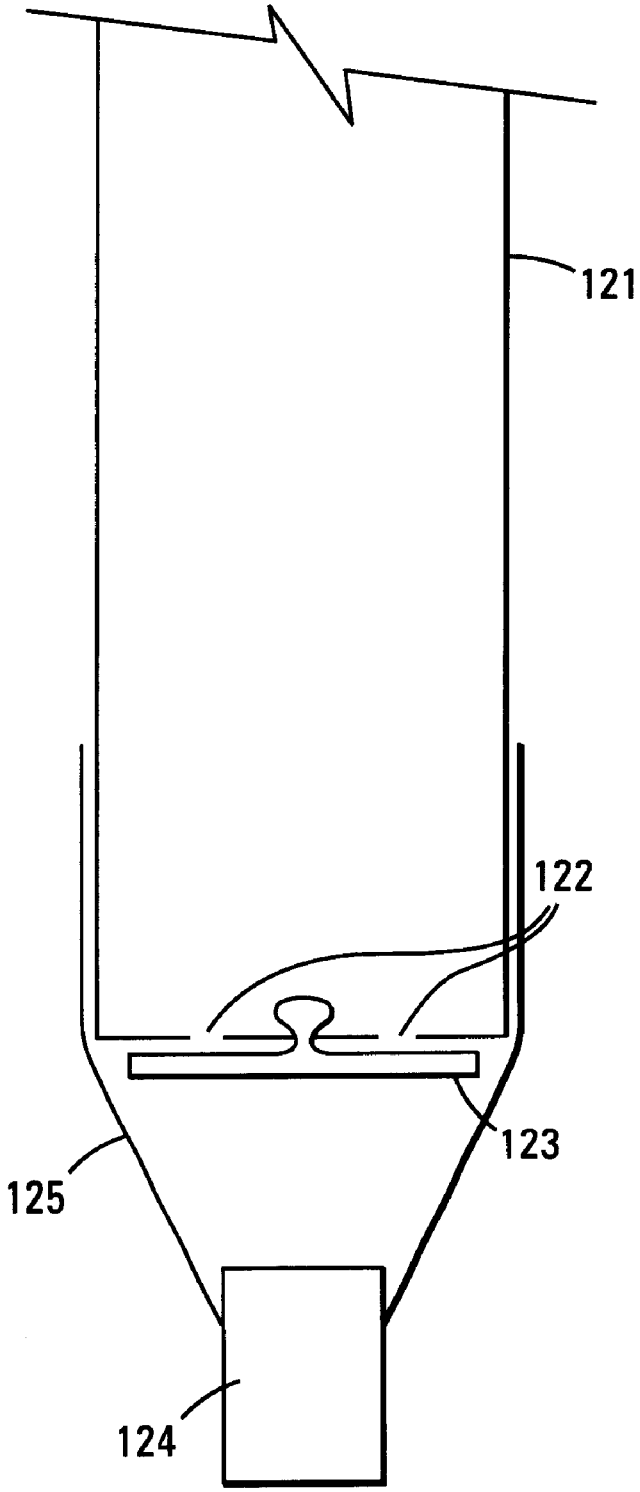
FIG. 5 is the side view of the first modification of a garden sprayer pump.

FIG. 5 shows how an aerator 124 may be attached to a garden sprayer so that it produces fine bubbles without losing the function of its standard one-way valve 123. A pump body (unnumbered) is defined by pump body walls 121 which further define air exit holes 122. A sleeve 125 encloses the end of the pump body (unnumbered) proximate the air exit holes 122. The one-way valve 123 is adapted so as to permit the flow of air through the sleeve 125 toward the aerator 124.

Figure 6:
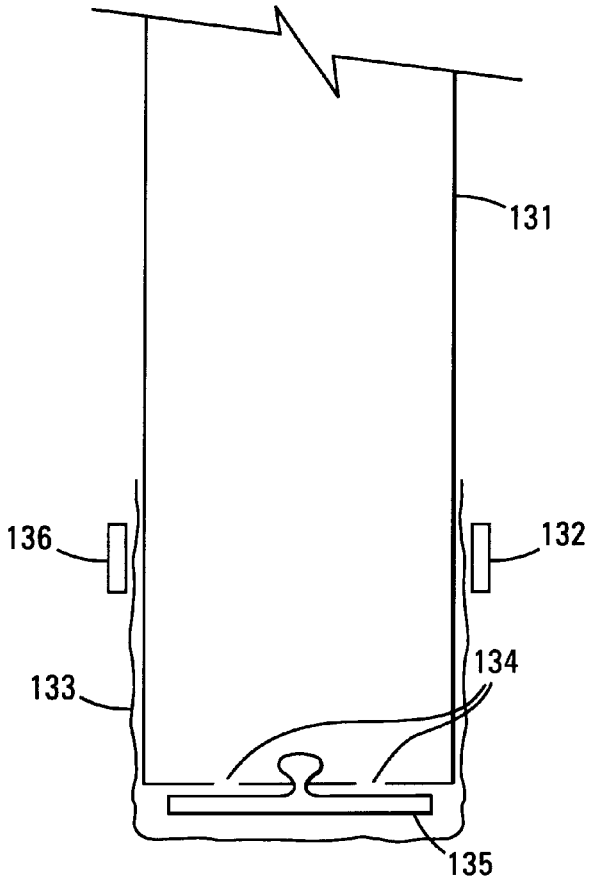
FIG. 6 is the side view of the second modification of a garden sprayer pump.

FIG. 6 shows how a porous fabric 133 may be fastened around a garden sprayer by a retaining sleeve 132 so that the porous fabric 133 forms the small air bubbles without losing the function of the standard one-way valve 135. The garden sprayer defines a pump body (unnumbered) which further defines pump body walls 131. A plunger (not shown) is fitted into the pump body walls 131 in a slidable sealing manner so as to force air during a down stroke. As air is forced downward, air exit holes 134 permit the air to pass through the sprayer. The one-way valve 135 is adapted so as to permit the flow of air through the air exit holes 134 so as to finally be released only through the porous fabric 133, which facilitates the formation of small bubbles. The porous fabric 133 is held in place by means of a retaining sleeve 136.

Figure 7:
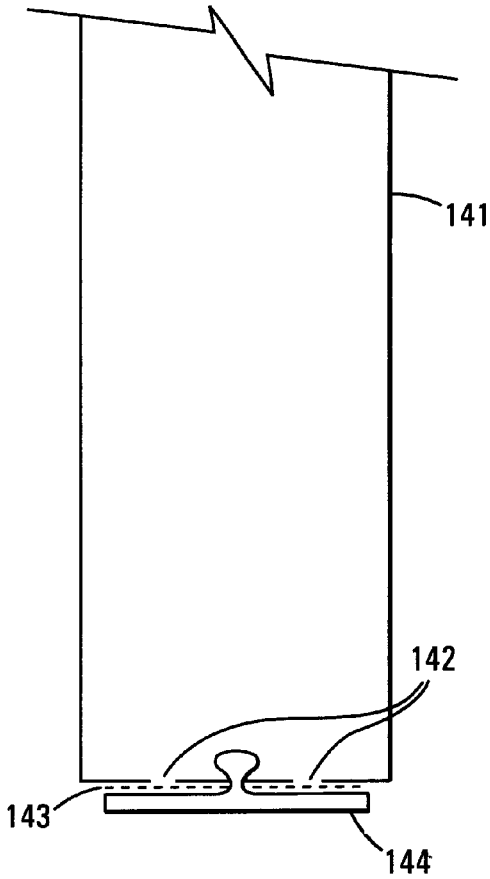
FIG. 7 is the side view of the third modification of a garden sprayer pump.

FIG. 7 shows how a porous fabric 143 may be installed between a garden sprayer's (unnumbered) air exit holes 142 and the one-way valve 144, with the porous fabric 143 facilitating the formation of small bubbles. The garden sprayer (unnumbered) defines a pump body (unnumbered) which further defines pump body walls 141. A plunger (not shown) is fitted into the pump body walls 141 in a slidable sealing manner so as force air during a down stroke. As air is forced downward, air exit holes 142 permit the air to pass through the sprayer. The one-way valve 144 is adapted so as to permit the flow of air through the air exit holes 142 so as to be finally released only through the layer of porous fabric 143 interposed between the one way valve 144 and air exit holes 142.

Figure 8:
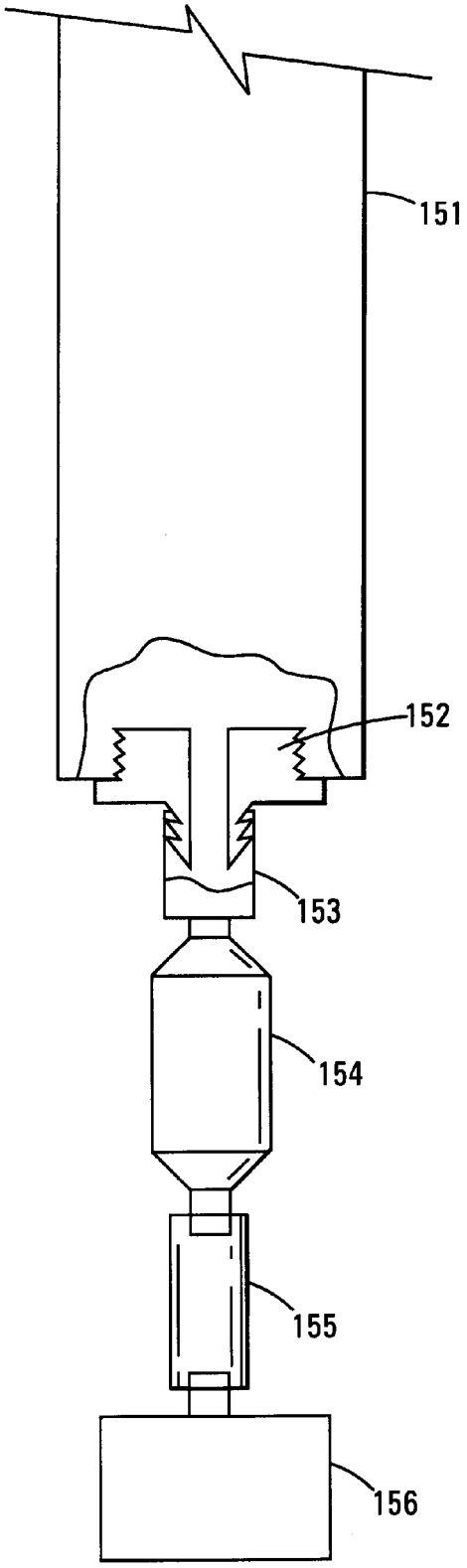
FIG. 8 is the side view of the fourth modification of a garden sprayer pump.

FIG. 8 shows how the end of a garden sprayer (unnumbered) may be further modified by fastening a plumbing fitting 152 into a drilled hole (unnumbered) in the wall of a pump body 151. Between and in fluid communication the plumbing fitting 152 and a one-way valve 154 is tubing 153. A separate piece of tubing 155 is in fluid communication with and connects the one-way valve 154 to the aerator 156.

The garden sprayer fitted with one of the previously described modifications may require further modification. Foam production requires that the foam to be sprayed be drawn from near the top of the container (not shown), or at least above the level of the liquid (not shown) allowing sufficient space for the formation of bubbles above the liquid level. Many garden sprayers have a draw tube (not shown) that goes to the bottom (not shown) of the container (not shown) to draw liquid (not shown) out of the tank (not shown). If the draw tube is removed the sprayer will usually draw foam from near the top of the tank.

Figure 9:
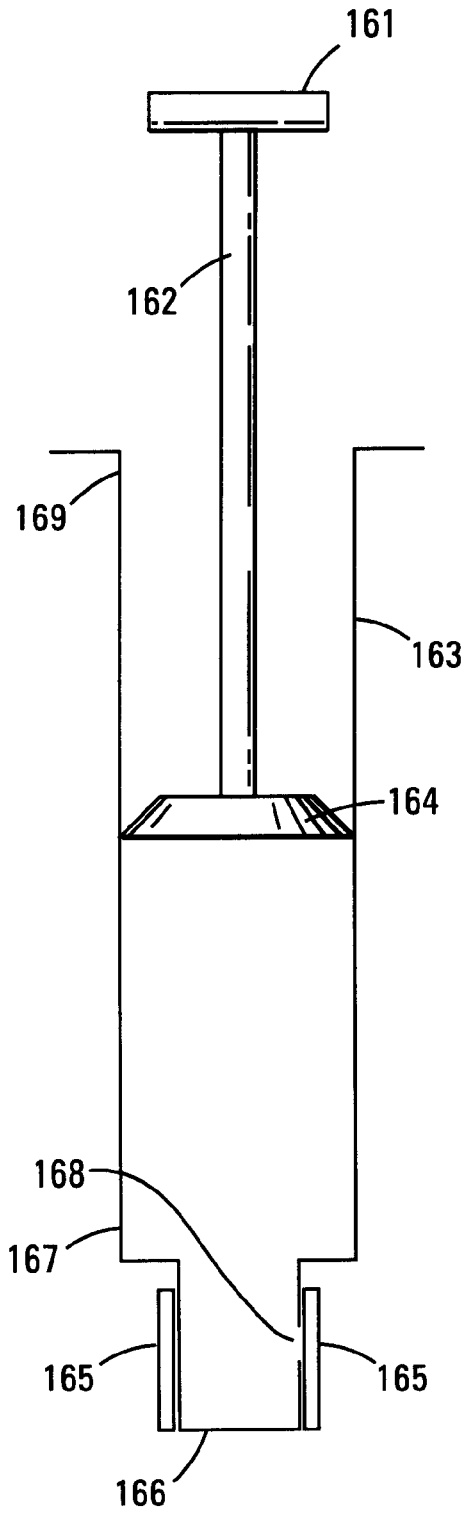
Fig. 9 Prior Art
FIG. 9 is the side view of a prior art small garden sprayer pump.

FIG. 9 shows the design of the air pump plunger 164 from a small (approximately one liter) prior art hand-held plant sprayer (not shown). A plunger 164 is slidably seal fitted into a longitudinal pump body 167 defined by pump body walls 163 and a top 169, which, when moved toward the bottom 166 of the pump body, pumps air. A plunger shaft 162 is attached to a plunger shaft handle 161 to aid in the operator's comfort and efficiency. The prior plant sprayer can be modified to form small bubbles needed for foam production in a similar manner to the modifications to the plunger 114 of FIG. 4: (1) Attach an aerator (not shown) with a sleeve (not shown) that retains the standard one-way valve 165 function, (2) Attach a porous fabric material (not shown) so that the standard one-way valve function is retained, (3) Insert a porous material (not shown) between the air exit hole(s) 168 and the one way valve 165, and (4) Attach a plumbing fitting (not shown) which connects to a one-way valve (not shown) and aerator (not shown).

The small sprayer is then modified so that the foam will be drawn from near the top (not shown) of the container (not shown), or at least above the level of the liquid.

Some garden sprayers use powered air pumps (powered by rechargeable batteries, engines, etc.)(not shown). They can also be modified so that the air which enters the tank (not shown) goes through an aerator (not shown) near the bottom of the liquid (not shown), producing air bubbles. The small bubbles are then drawn off from near the top of the tank (not shown), where they compress into foam and are sprayed out as foam. This arrangement provides a high volume of foam and may be useful for garden/agricultural applications, car wash foam, and for fire extinguishers, etc.

Figure 10:
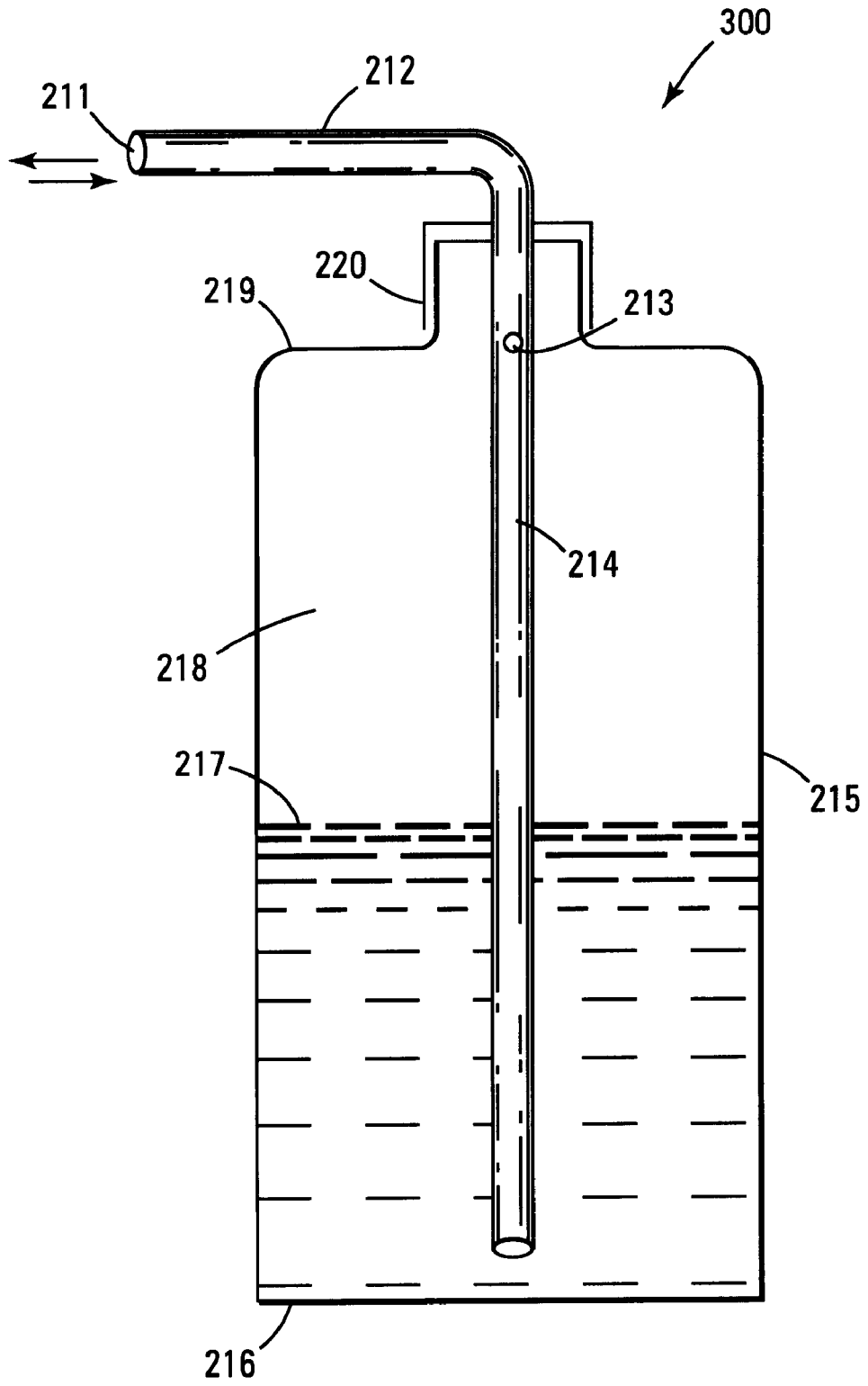
FIG. 10 is the side view of the fourth embodiment of the invention.

FIG. 10 shows a fourth embodiment of a foam generating device 300 in which the container 215 uses itself as the air pump. The container 215 defines a bottom 216 and a removable cap 220 for replenishing liquid 217 at the top end 219 of the container 215. When the container 215 is squeezed, liquid 217 flows through the dip tube 214 at the same time air in the air space 218 flows into the dip tube 214 through the hole(s) 213. The air and liquid 217 combine to make bubbles which are eventually compressed into foam while being forced through the tube 212 from the container 215. When the container 215 is allowed to expand, air enters through tube opening 211 and eventually through the dip tube hole(s) 213 to refill the air space 218 on top of the liquid 217.

The dip tube 214 extends nearly to the bottom 216 of the container 215, so that it is below the level of the liquid 217, insuring that liquid 217 will flow through the dip tube 214 when the container 215 is squeezed.

The hole(s) 213 in the dip tube 214 are located inside the container 215, above the liquid 217 level, and preferably near the top of the dip tube 214 so air will flow into the hole(s) 213 when the container 215 is squeezed. The size and number of hole(s) 213 may vary. Generally, hole(s) 213 of 1/16 inch diameter and smaller are preferred. The preferred number of hole(s) 213 depends on hole size, but is generally between one and eight.

Hole(s) 213 may be formed directly into the standard dip tube 214 or may be located upstream or downstream from a flow restriction (not shown) or venturi constriction (not shown). Hole(s) 213 may be simple perforations of the tube 214, or may be directional or have intruding nozzles (not shown).

This method of mixing air and liquid 217 to form foam also works if the container 215 has an external air pump (not shown). The air pump (not shown) provides air to the air space 218 inside the container 215, which pressurizes the container 215 and forces both the liquid 217 and air to flow into the dip tube 214, and form foam on the way out of the container 215.

Figure 11:
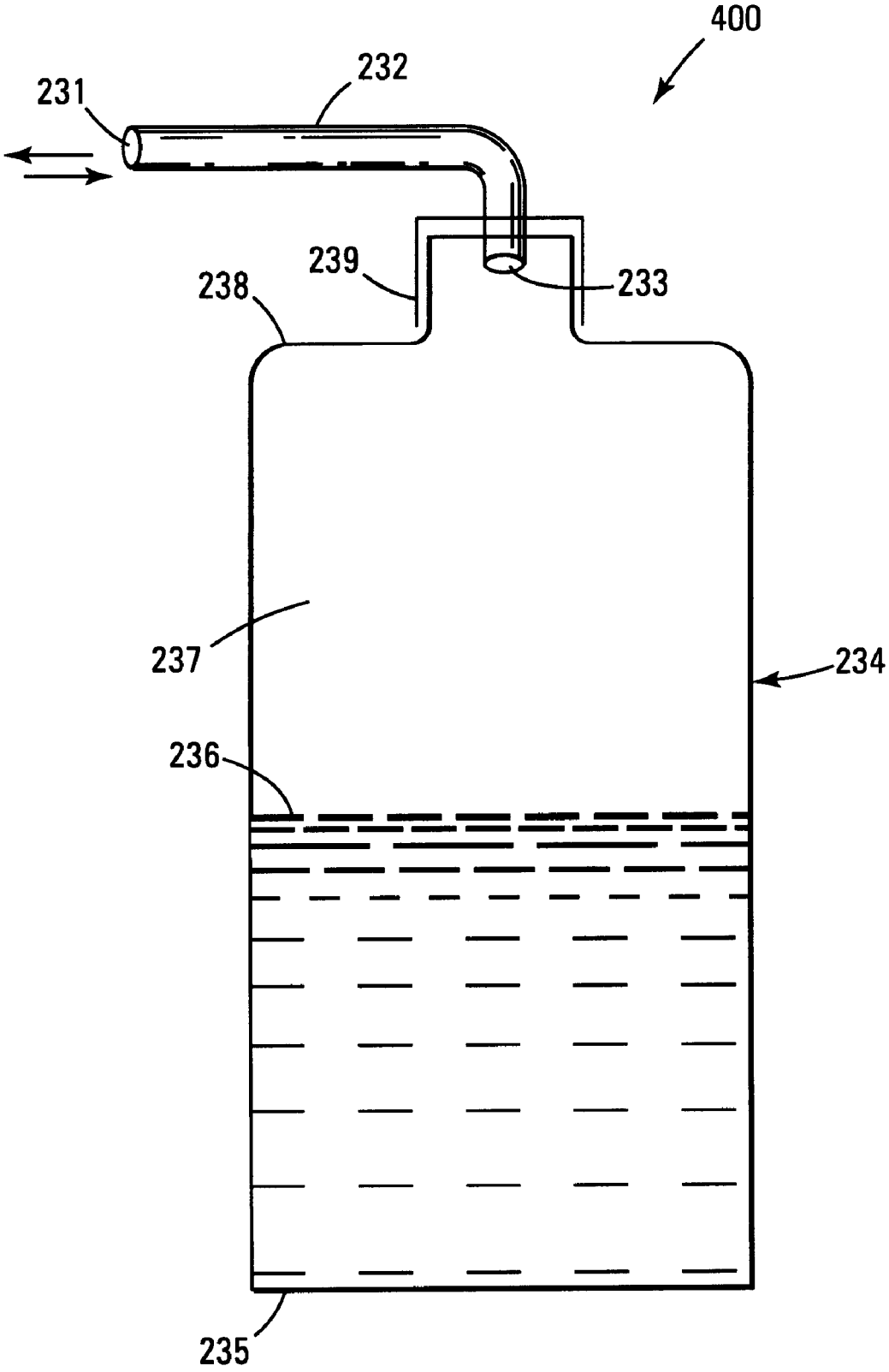
FIG. 11 is the side view of the fifth embodiment of the invention.

FIG. 11 shows a fifth embodiment device 400 for generating foam from a container 234 defining a top 238 and a bottom 235 which uses itself as the air pump. A removable cap 239 for replenishing liquid 236 is fitted to the top 238 of the container 234. The container 234 is shaken, which fills the air space 237 on top of the liquid 236 with fine bubbles. As the container 234 is squeezed, the bubbles are compressed as they flow through the foam exit tube 232 and flow out of the container 234 through the tube opening 231 as foam. When the container 234 is allowed to expand to normal volume, air once again fills the air space 237 on top of the liquid 236. The container 234 may be shaken again to continue the foam generation procedure.

The opening 233 of the foam exit tube 232 is sufficiently constricting that it compresses the bubbles into foam as the container 234 is squeezed. The preferred inner diameter of the foam exit tube 232 is from about 0.025 inches to about 0.25 inches. A larger inner diameter is less constricting and produces less dense foam. A smaller inner diameter is more constricting and produces more dense foam. The foam exit tube 232 may have a cross section shape other than round, as long as it produces the desired constriction which forms the bubbles into foam. For optimum foam, it may be desirable to let the liquid 236 settle for several seconds between shaking and squeezing the container 234.

What is claimed is:

1. A device, comprising:

(a) an elastic pliant bottle defining a single bottle chamber having an upper portion and a lower portion;

(b) an air intake orifice through the bottle in fluid communication with the lower portion of the bottle chamber;

(c) a first one way valve in fluid communication with the air intake orifice effective for preventing the flow of air out of the bottle chamber through the air intake orifice;

(d) an aerator within the bottle chamber in sealing fluid communication with the air intake orifice;

(e) a foam exit port from the bottle chamber in fluid communication with the upper portion; and (f) a second one way valve in fluid communication with the foam exit port effective for preventing the flow of air into the bottle chamber through the foam exit port;

(g) wherein (i) air is drawn into the bottle chamber through the air intake orifice and foam is formed when the bottle resumes an original shape after being deformed, and (ii) foam is expelled from bottle chamber through the foam exit port when the bottle is again deformed.

2. The device of claim 1 further comprising means for resealably allowing access to the bottle chamber so as to add a foamable liquid to the chamber.

3. The device of claim 1 wherein the first and second one way valves are located within the bottle chamber.

4. The device of claim 1 wherein the lower portion of the bottle chamber contains a foamable liquid.

5. A method of forming and dispensing foam, comprising:

(a) obtaining the device of claim 1;

(b) placing a foamable liquid within the lower portion of the bottle chamber;

(c) forcing air into the bottle chamber through the air intake orifice so as to form foam within the upper portion of the bottle chamber; and (d) deforming the bottle chamber following step (c) to cause the foam to exit the bottle chamber through the foam exit port.

6. A device, consisting of:

(a) an elastic pliant bottle defining a bottle chamber having an upper portion, a lower portion and an original shape;

(b) a foamable liquid within the lower portion of the bottle chamber;

(c) a port through the bottle in direct fluid communication with only the upper portion of the bottle chamber; and (d) wherein (i) agitation of the foamable liquid within the bottle chamber will cause the foamable liquid to mix with air and form foam, (ii) squeezing of the bottle will cause the foam to exit the bottle chamber through the port, and (iii) discontinuance of squeezing will allow the bottle chamber to return to the original shape with the suction of air into the bottle chamber.

7. The device of claim 6 wherein the port is located through that portion of the bottle defining the upper portion of the bottle chamber.

8. A method of forming and dispensing foam, comprising:

(a) obtaining the device of claim 6;

(b) agitating the foamable liquid within the bottle so as to form foam within the upper portion of the bottle chamber; and (c) squeezing the bottle so as to deform the bottle chamber and thereby cause the foam to exit the bottle chamber through the port.

9. A device, comprising:

(a) an elastic pliant bottle defining a single bottle chamber having an upper portion, a lower portion and an original shape;

(b) a foamable liquid within the lower portion of the bottle chamber;

(c) a port through the bottle in direct fluid communication with only the upper portion of the bottle chamber; and (d) wherein (i) agitation of the foamable liquid within the bottle chamber will cause the foamable liquid to mix with air and form foam, (ii) squeezing of the bottle will cause the foam to exit the bottle chamber through the port, and (iii) discontinuance of squeezing will allow the bottle chamber to return to the original shape with the suction of air into the bottle chamber.

10. The device of claim 9 wherein the port is located through that portion of the bottle defining the upper portion of the bottle chamber.

11. A method of forming and dispensing foam, comprising:

(a) obtaining the device of claim 9;

(b) agitating the foamable liquid within the bottle so as to form foam within the upper portion of the bottle chamber; and (c) squeezing the bottle so as to deform the bottle chamber and thereby cause the foam to exit the bottle chamber through the port.

12. A device, comprising:

(a) an elastic pliant bottle defining a bottle chamber having an upper portion, a lower portion and an original shape;

(b) a foamable liquid within the lower portion of the bottle chamber;

(c) a port through the bottle in direct unobstructed fluid communication with only the upper portion of the bottle chamber; and (d) wherein (i) agitation of the foamable liquid within the bottle chamber will cause the foamable liquid to mix with air and form foam, (ii) squeezing of the bottle will cause the foam to exit the bottle chamber through the port, and (iii) discontinuance of squeezing will allow the bottle chamber to return to the original shape with the suction of air into the bottle chamber.

13. The device of claim 12 wherein the port is located through that portion of the bottle defining the upper portion of the bottle chamber.

14. A method of forming and dispensing foam, comprising:

(a) obtaining the device of claim 12;

(b) agitating the foamable liquid within the bottle so as to form foam within the upper portion of the bottle chamber; and (c) squeezing the bottle so as to deform the bottle chamber and thereby cause the foam to exit the bottle chamber through the port.

15. A device, comprising:

(a) an elastic pliant bottle defining a single bottle chamber having an upper portion and a lower portion;

(b) a common tube extending through the bottle in fluid communication with the bottle chamber;

(c) an air intake tube in fluid communication with the common tube and the lower portion of the bottle chamber;

(d) a first one way valve in fluid communication with the air intake tube effective for preventing the flow of air out of the bottle chamber through the air intake tube;

(e) an aerator within the lower portion of the bottle chamber in sealing fluid communication with the air intake tube;

(f) a foam exit tube in fluid communication with the common tube and the upper portion of the bottle chamber; and (g) a second one way valve in fluid communication with the foam exit tube effective for preventing the flow of air into the bottle chamber through the foam exit tube;

(h) wherein (i) air is drawn into the bottle chamber through the common tube and the air intake tube so as to form foam when the bottle resumes an original shape after being deformed and (ii) foam is expelled from bottle chamber through the foam exit tube and the common tube when the bottle is again deformed.

16. The device of claim 15 further comprising means for resealably allowing access to the bottle chamber so as to add a foamable liquid to the chamber.

17. The device of claim 15 wherein the first and second one way valves are located within the bottle chamber.

18. The device of claim 15 wherein the lower portion of the bottle chamber contains a foamable liquid.

* * * * *